US006834432B1

(12) United States Patent
Taylor, Jr.

(10) Patent No.: US 6,834,432 B1
(45) Date of Patent: Dec. 28, 2004

(54) POCKET KNIFE WITH LOCK DESIGN

(75) Inventor: William Joseph Taylor, Jr., Marietta, GA (US)

(73) Assignee: Proceeding Corp., Taipei (TW)

( * ) Notice: Subject to any disclaimer, the term of this patent is extended or adjusted under 35 U.S.C. 154(b) by 0 days.

(21) Appl. No.: 10/627,696

(22) Filed: Jul. 28, 2003

(51) Int. Cl.[7] ..... B26B 1/04
(52) U.S. Cl. ..... 30/161; 30/160
(58) Field of Search ..... 30/161, 160, 331, 30/133, 155, 159, 158, 340; 7/118, 119, 120

(56) References Cited

U.S. PATENT DOCUMENTS

| | | | | | |
|---|---|---|---|---|---|
| 4,274,200 | A | * | 6/1981 | Coder | 30/161 |
| 4,570,341 | A | * | 2/1986 | Konneker | 30/161 |
| 5,511,310 | A | * | 4/1996 | Sessions et al. | 30/161 |
| 5,699,615 | A | * | 12/1997 | Chen | 30/160 |
| 5,794,346 | A | * | 8/1998 | Seber et al. | 30/161 |
| 5,826,340 | A | * | 10/1998 | Hull | 30/161 |
| 5,875,552 | A | * | 3/1999 | Chen | 30/161 |
| 6,308,420 | B1 | * | 10/2001 | Moser | 30/161 |
| 6,701,621 | B2 | * | 3/2004 | Kain et al. | 30/160 |
| 2002/0104220 | A1 | * | 8/2002 | Marfione | 30/160 |
| 2003/0140500 | A1 | * | 7/2003 | Cheng | 30/159 |
| 2004/0020058 | A1 | | 2/2004 | Vallotton | |
| 2004/0068874 | A1 | * | 4/2004 | Chu | 30/161 |

FOREIGN PATENT DOCUMENTS

| | | |
|---|---|---|
| WO | WO 2004/033163 | 4/2004 |

* cited by examiner

*Primary Examiner*—Allan N. Shoap
*Assistant Examiner*—Ghassem Alie
(74) *Attorney, Agent, or Firm*—Rosenberg, Klein & Lee

(57) ABSTRACT

A pocket knife with lock design is disclosed. This foldable knife has a pivot joint, a blade controlled by the pivot joint, a safety lock corresponding to the side wall of the blade, and a resilient pin, wherein the back end of the blade has a shoulder and a pin catch. The safety lock has a spring tab with a raised head that is moved to touch the back of the blade after the blade is pulled out from the handle by a predetermined angle. The resilient pin is placed in a chamber within inner space of the handle, where one end pushes against the shoulder of the blade for supplementing the driving force to pull out the blade to an open position.

9 Claims, 9 Drawing Sheets

POCKET KNIFE WITH LOCK DESIGN

BACKGROUND OF THE INVENTION

1. Field of the Invention

The present invention relates to a pocket knife with a lock design, in particular to a foldable knife that provides supplemental driving force to extend the blade of the knife from the handle to an open position by a semi-automatic operation.

2. Description of Related Arts

The current designs of pocket knives can be categorized as the flick knife and the foldable knife. The flick knife utilizes the pressing force on the lock release mechanism of the handle to unlock the spring, and then the recoiling force of the spring causes the blade to shoot out from the front end of the handle. According to the designs of flick knives, the blade moved by the recoiling force of the spring can also cause bodily harm to the user if the flick knife is not properly handled. If the flick knife is dropped accidentally when being carried or operated improperly, the razor-sharp blade may be ejected automatically when the knife falls to the ground and receives a jolt.

However, by the design of the foldable knife, the movement of the blade is controlled by a pivot joint, and the blade has to be opened out and returned manually, and is received in the inner space of the handle. Unlike the flick knife, the foldable knife does not use any spring mechanism to extend the blade from the handle. This design makes it safer to operate but, at the same time, sacrifices some operability.

Since the design of conventional foldable knife cannot provide automatic opening of the knife and operation safety at the same time, a modified foldable knife has been proposed by the applicant, in which the structure of the modified foldable knife has incorporated a supplemental driving aid, formed by a holding block, a guide roller and a resilient pin installed inside the handle, such that when the user pulls out the blade from the handle of the knife at a predetermined angle, then a supplemental driving force will be produced by the action of the resilient pin to assist the extension of the blade to the open position, thus enhancing the operability by means of a semi-automatic operation.

Although the modified foldable knife design is able to meet the users' expectation for automatic operation, the mechanical driving aid of the foldable knife requires the addition of a guide roller in the handle corresponding to the side wall of the blade that takes the pressure from by the resilient pin. therefore, the thickness of the handle has to be increased to meet the above requirement. However, the enlarged size of the foldable knife will affect the portability of the knife, and also the guide roller and the resilient pin as part of the mechanical driving aid to supplement the extension of the blade do not work in perfect unison at all times.

SUMMARY OF THE INVENTION

The main object of the present invention is to provide a pocket knife with a lock design incorporating a supplemental mechanical driving aid to solve the prior art problem of thickness of the foldable knife and to improve the supplemental driving force when extending the blade from the handle.

To this end, the present invention uses a pivot joint at the front end of handle to control the movement of the blade, a safety lock placed inside handle corresponding to the side wall of blade in the closed position, and a resilient pin installed in the handle corresponding to the back end of the blade, wherein the back end of the blade has a shoulder for engaging the resilient pin and a pin catch. The safety lock has a spring tab with a raised head, which is used to press against the back end of the blade when the blade is being extended from the handle, and the resilient pin is installed inside the chamber of the handle, where one end is fixed, and the other end is pushed against the shoulder of the blade, for supplemental driving force blade when the blade is being extracted from the handle.

The present invention provides a pocket knife with a foldable design that allows the blade to be received within the inner space of the handle.

The present invention also provides a supplemental driving aid that can force the blade of a pocket knife to extend by means of a semi-automatic operation.

The present invention also provides a simplified structural design for a pocket knife by providing a suitable thickness of the handle to meet the portability and storage requirements.

The present invention is also characterized in that a resilient pin is used in the design to drive the blade directly when the blade is being pulled out from the handle to the open position.

The features and structure of the present invention will be more clearly understood when taken in conjunction with the accompanying drawings.

DETAILED DESCRIPTION OF THE PREFERRED EMBODIMENT

Figure 1:
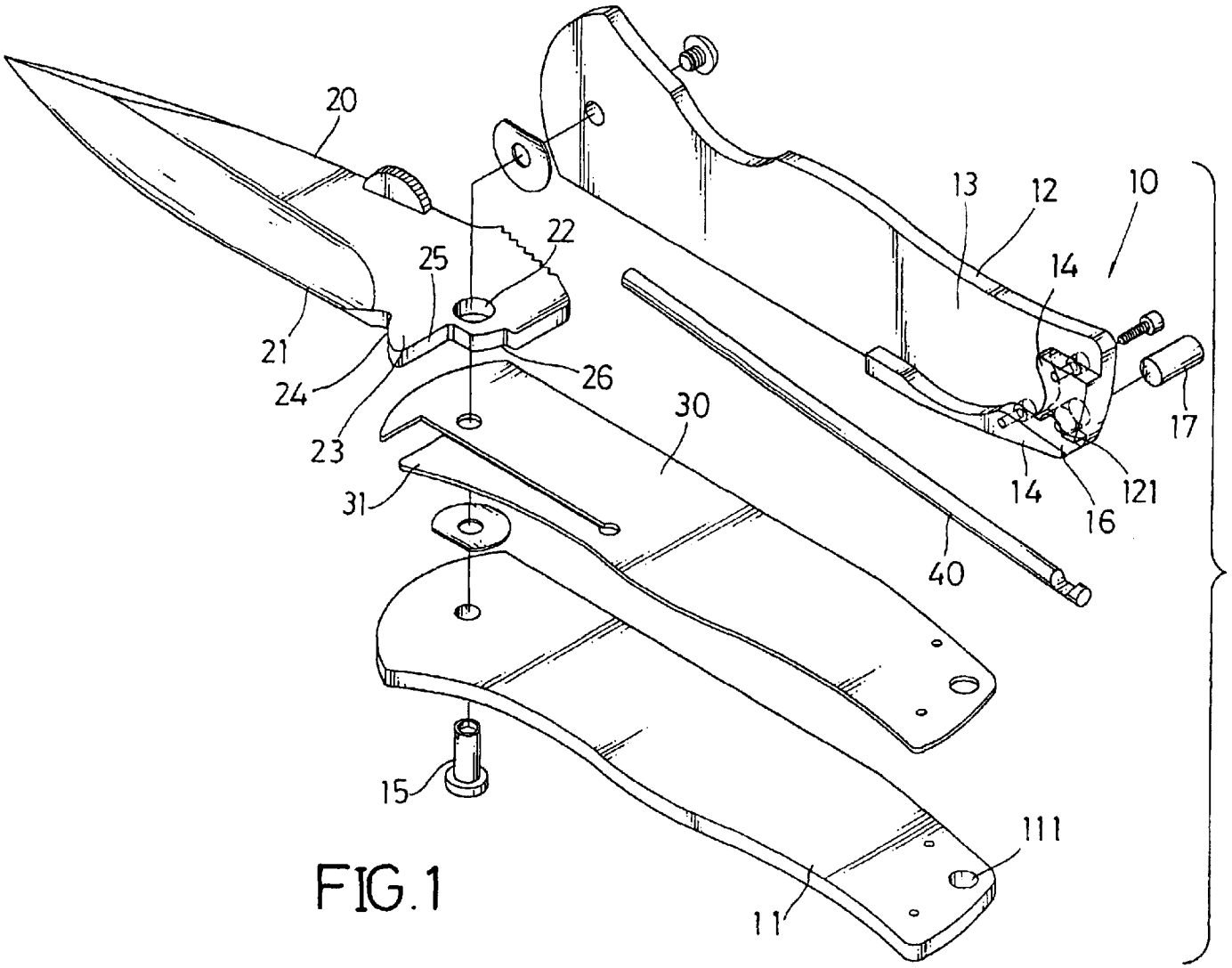
FIG. 1 is an exploded diagram of the pocket knife with a lock design in accordance with the present invention.

The present invention is illustrated in conjunction with a first preferred embodiment as shown in FIG. 1. This foldable knife has a handle (10) including a pivot joint (15), a blade (20) controlled by the pivot joint (15), a safety lock (30) corresponding to the side wall of the blade (20), and a resilient pin (40). The handle (10) is formed by a first half (11) and a second half (12), and has an opening at the front. The first and second halves (11, 12) are joined together in a conventional manner such as by using screw, rivets and so on. A chamber (13) is defined by the side walls of the handle (10) for holding the resilient pin (40). The pivot joint (15) is formed at the front end of handle (10) for receiving the blade (20) into the handle (10).

A holding block (14) is installed on a side wall of the chamber (13) opposite to the pivot joint (15) for holding one end of the resilient pin (40) firmly in position.

The blade (20) has an axis, a cutting side (21), a blunt side, a pointed end and a pivot end. The pivot end defines a pivot hole (22) extending through the blade (20). A shoulder (23) formed on the pivot end of the blade (20) has a bevel shaped guiding edge (24) close to the cutting edge (21) and a driving edge (25) on the far end of cutting edge (21) perpendicular to the axis of blade (20). A pin catch (26) is formed between the cutting edge (21) and guiding edge (24).

The safety lock (30) is secured in the chamber (13) inside the handle (10) by the clamping force of the first and second halves (11, 12). In the preferred embodiment, the safety lock (30) is disposed between the blade (20) and first half (11) and has a push plate (31) adjacent to a side opening of the handle (10), where the free end of the push plate (31) forms a raised head for pushing against the pivot end of the blade (20) to move the blade (20) into an open position.

The resilient pin (40) is installed in the chamber (13) of the handle (10), wherein one end is held by the holding block (14) in the handle (10), and the other end touches the shoulder (23) of the blade (20) for supplementing the extension of the blade (20) to the open position.

Figure 2:
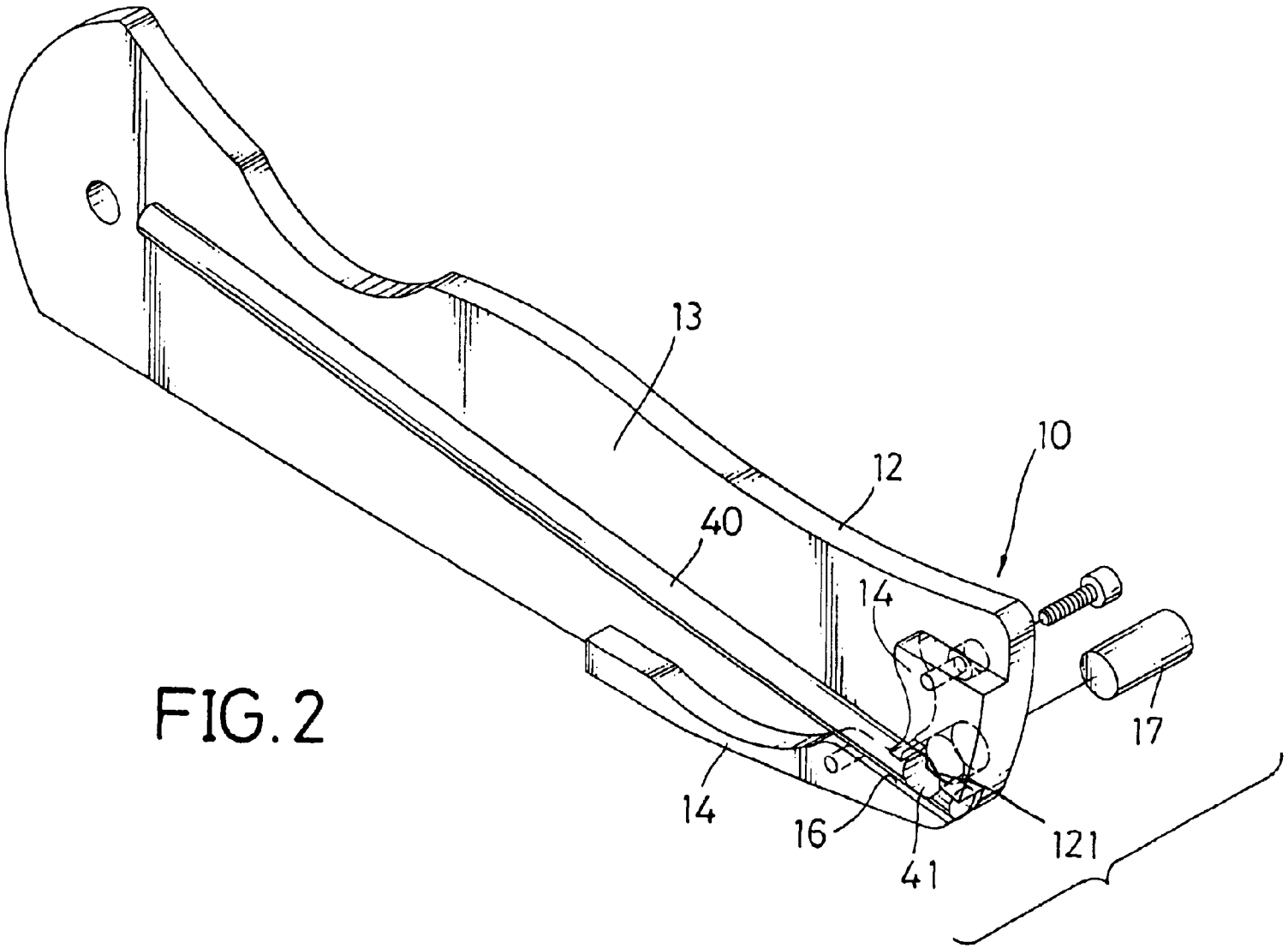
FIG. 2 is a partial assembly of the pocket knife previously shown in FIG. 1.
Figure 3:
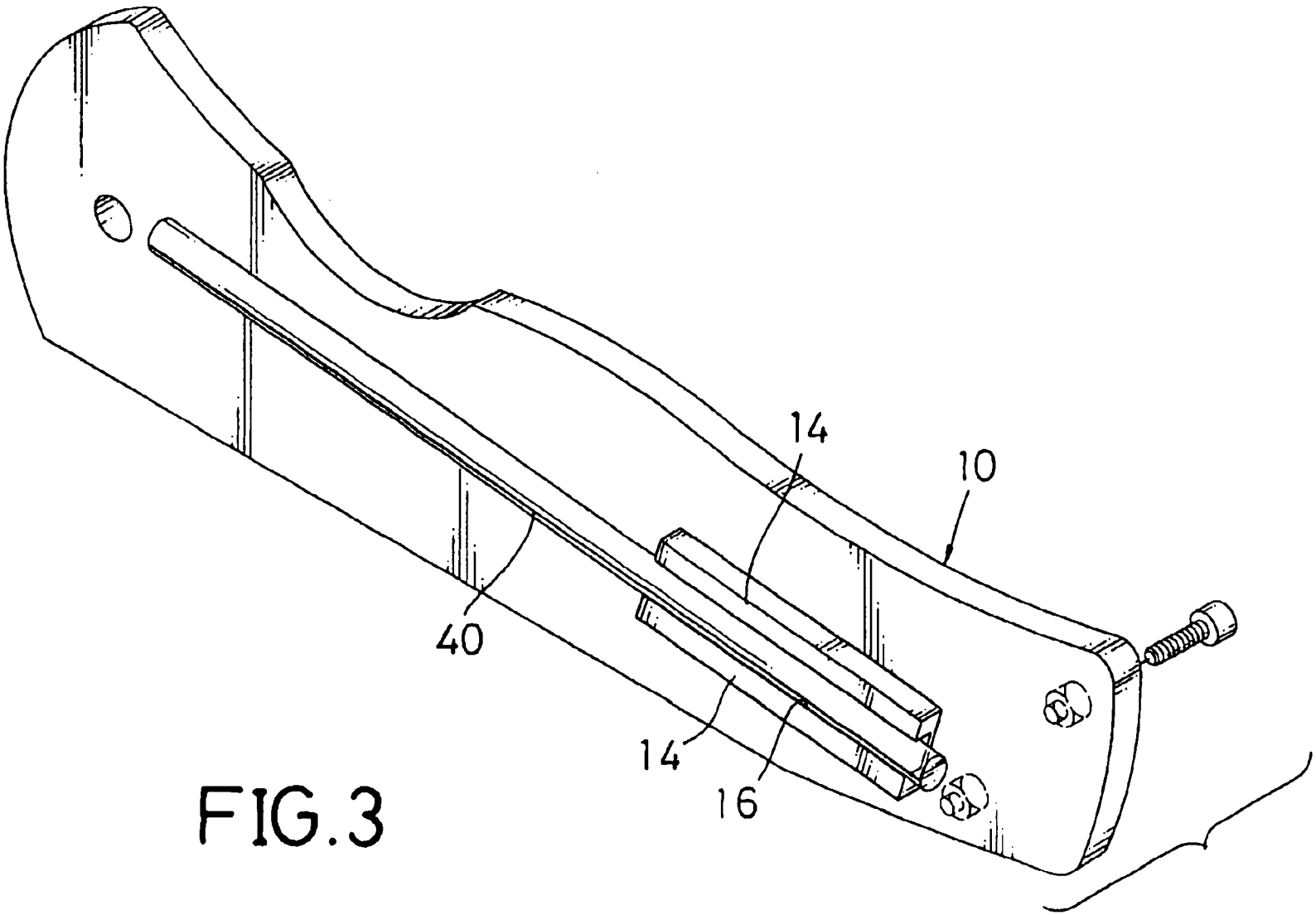
FIGS. 3 and 4 are different designs of the holding blocks to hold the resilient pin inside the handle.
Figure 4:
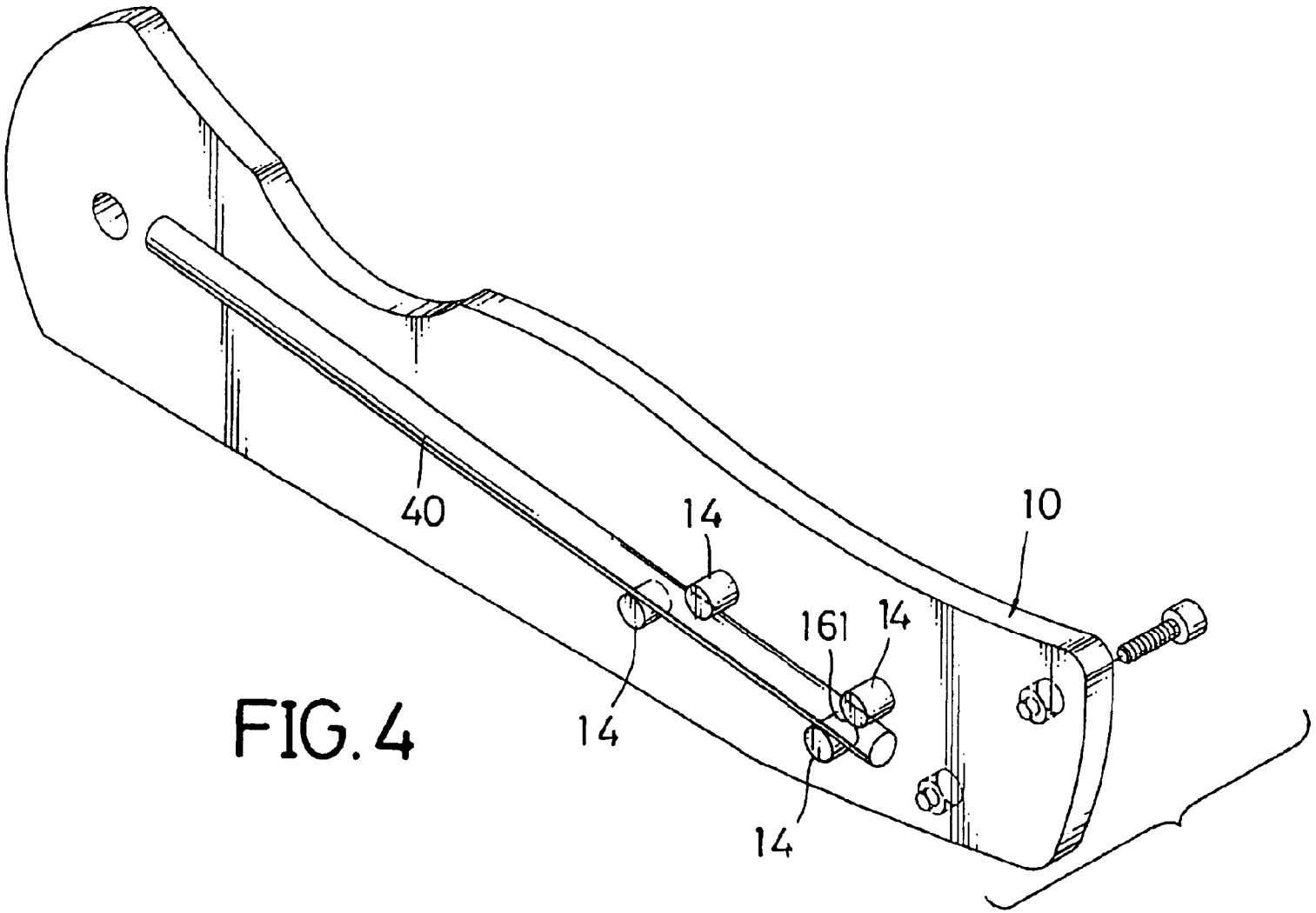

The holding blocks (14) installed in the chamber (13) of the handle (10), as shown in FIGS. 2 and 3, are placed side by side at the back end or the middle section of the second half (12), forming a channel (16) for keeping the resilient pin (40) in position. Alternatively, the holding block (14) can be formed by multiple blocks inside the chamber (13) of the handle (10), as shown in FIG. 4, and arranged in two rows in alternate positions or in a one-on-one arrangement. These two rows of holding blocks (14) form a channel (161) for keeping the base of the resilient pin (40) firmly in place. In a further embodiment, the holding block (14) can be a single block inside the chamber (13) of the handle (10) (not shown in the diagrams), where the inward facing end forms a channel (161) having an inward facing opening, as opposed to the closed other end, used for keeping the base of the resilient pin (40) firmly in place.

Figure 6:
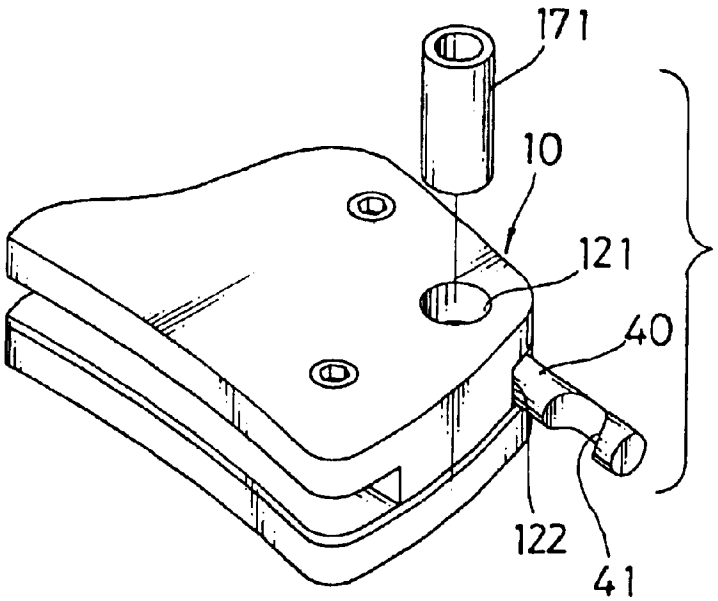
FIGS. 5-7 are different designs used to fix the resilient pin inside the handle.
Figure 5:
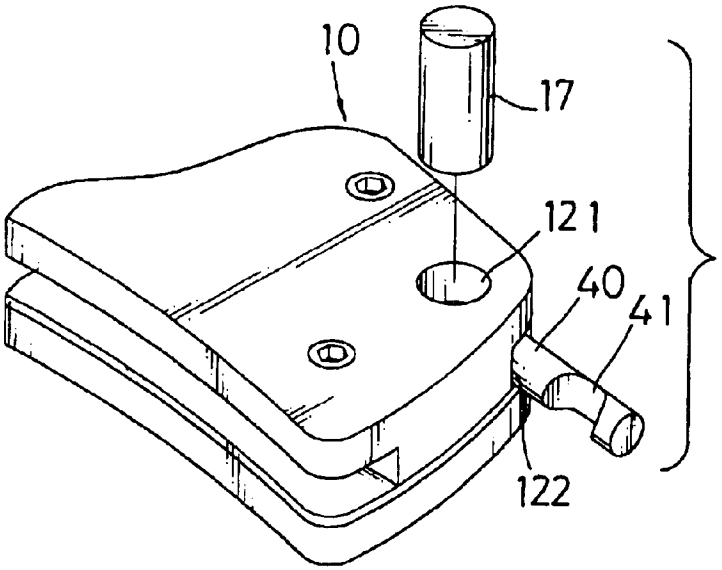

The resilient pin (40) is fixed on the base of the handle (10) to form a gap (41), and the handle (10) has through holes (111, 121) corresponding to the position of the gap (41) for installing a stopper rod (17), as shown in FIG. 5, or rivets (171), as shown in FIG. 6, or any other equivalent means for fixing the base of the resilient pin (40) inside the handle (10). Alternatively, the first half (11) and second half (12) of the handle (10) are installed with through holes or screw holes (not shown in the diagram) corresponding to the gap (41) for receiving screws to fix the base of the resilient pin (40) inside the handle (10).

The inner walls of the resilient pin (40) and the handle (10) are designed to interlock against each other (not shown in diagram) for fixing the base of the resilient pin (40) inside the handle (10). The resilient pin (40) is fixed on one side of the base of the handle (10).

Figure 7:
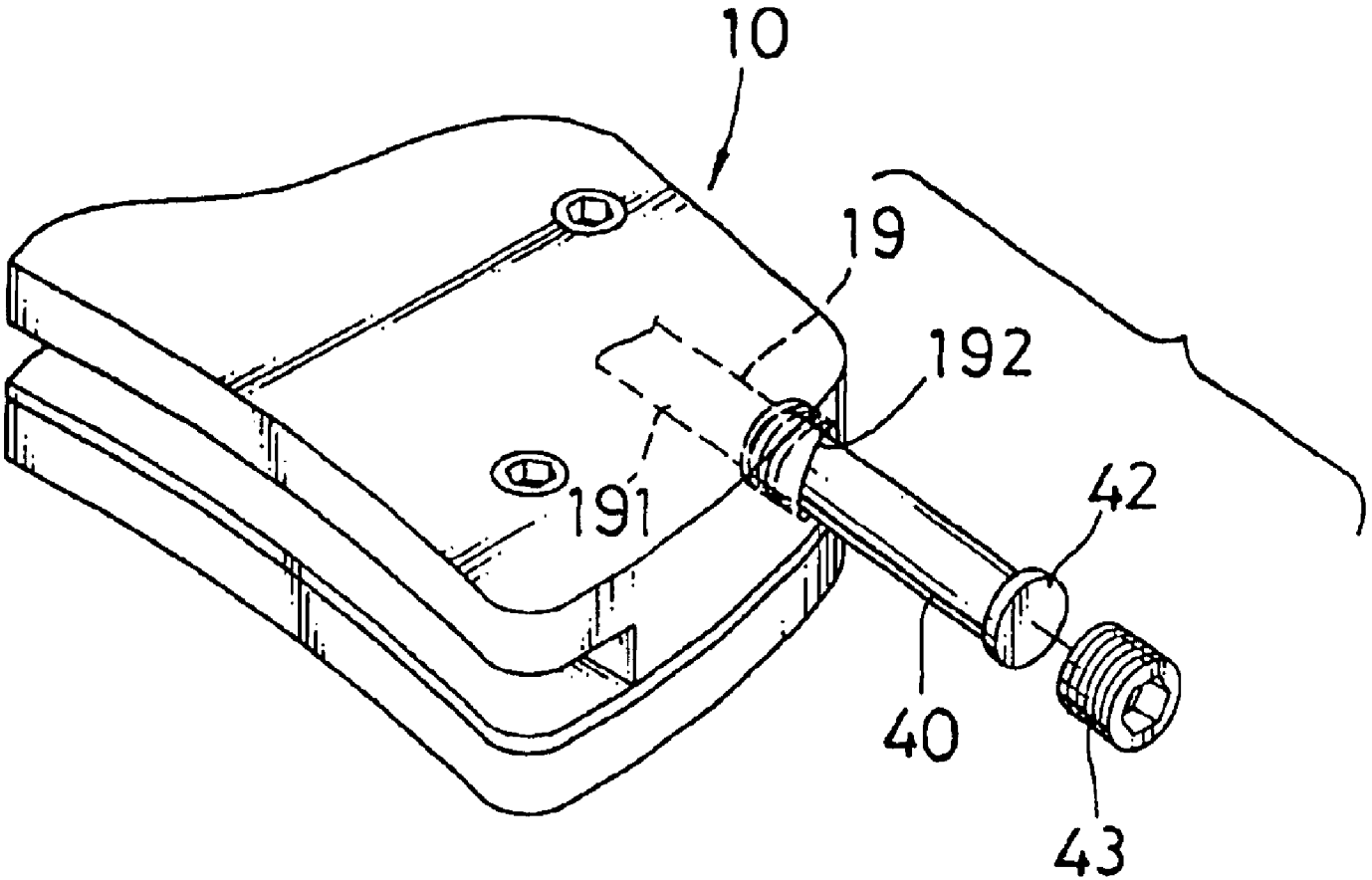

As shown in FIG. 7, the resilient pin (40) is fixed at the base of the handle (10) having a large diameter, and the pivot end of the handle (10) has a supporting pipe (19) corresponding to a back section of the channel (16), having a small diameter inner section (191) on one end and a larger diameter outer section (192) on the other end. The outer section (192) of the supporting pipe (19) corresponds with the large diameter base of the resilient pin (40) having screw threads formed on the inner wall. The inner section (191) corresponds with the outside diameter of the resilient pin (40). The resilient pin (40) is slid into the channel (16) of the handle (10) through the inner section (191) of the supporting pipe (19), and then the base (42) of the resilient pin (40) is then fixed onto the outer section (192) of the supporting pipe (19) using screws (43) for fixing the resilient pin (40) in the handle (10).

Figure 8:
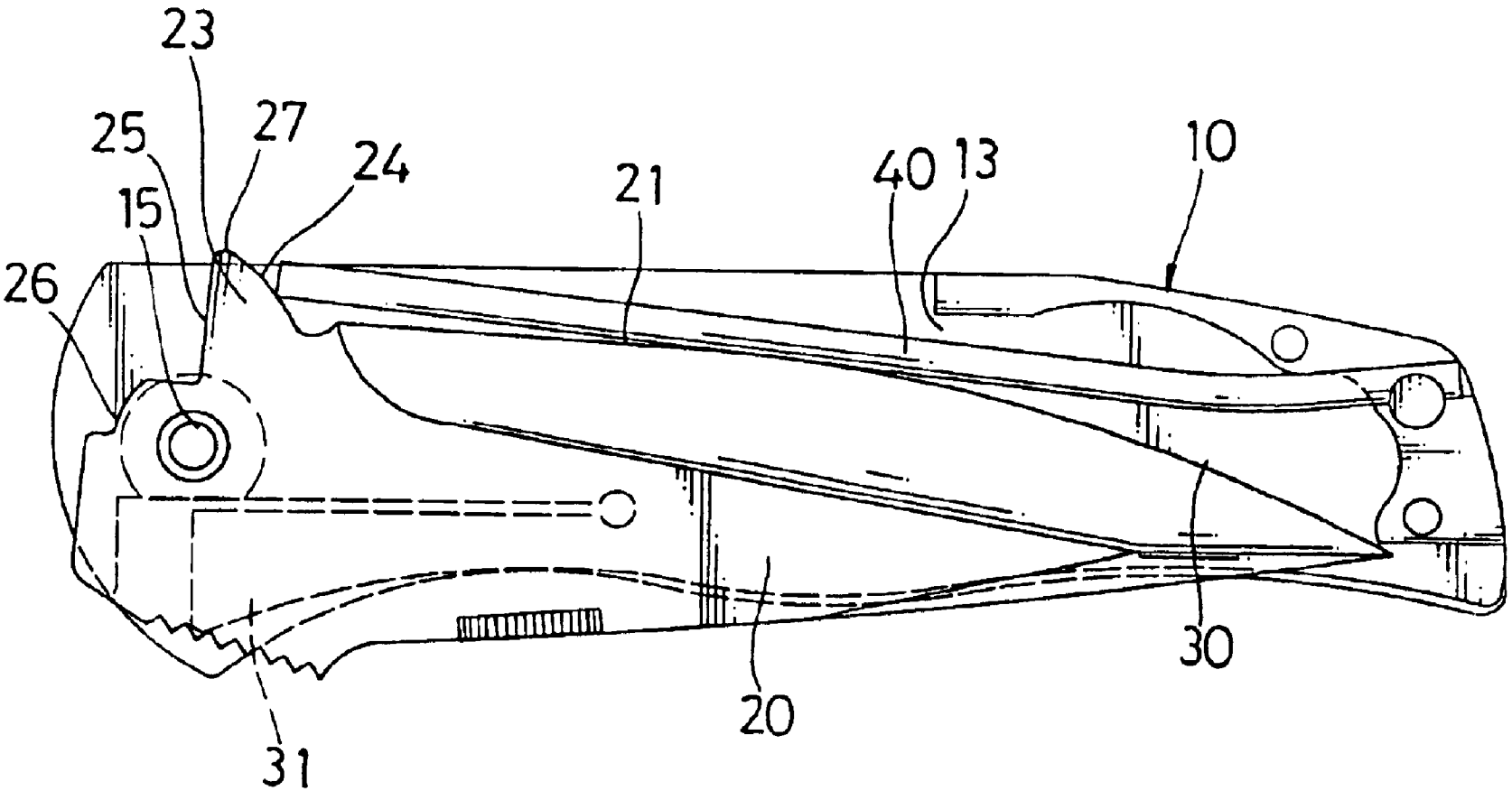
FIG. 8 is a plan view of the pocket knife previously shown in FIG. 1 currently having the blade in the closed position.

In actual operation, as shown in FIG. 8, when folding back the knife to a closed position, the blade (20) of the pocket knife is received by the handle (10). The blade (20) is pivotally moved back into the closed position in the handle (10), and the push plate (31) of the safety lock (30) is placed against the side of the blade (20). The resilient pin (40) is slightly bent and lodged on one side of the blade (20), and the free end of the safety lock (30) extends toward the guiding edge (24) of the blade shoulder (23). At the same time, the push plate (31) of the safety lock (30) is pushed against the blade (20) to offset the force of the resilient pin (40) applied on the blade (20).

Figure 9:
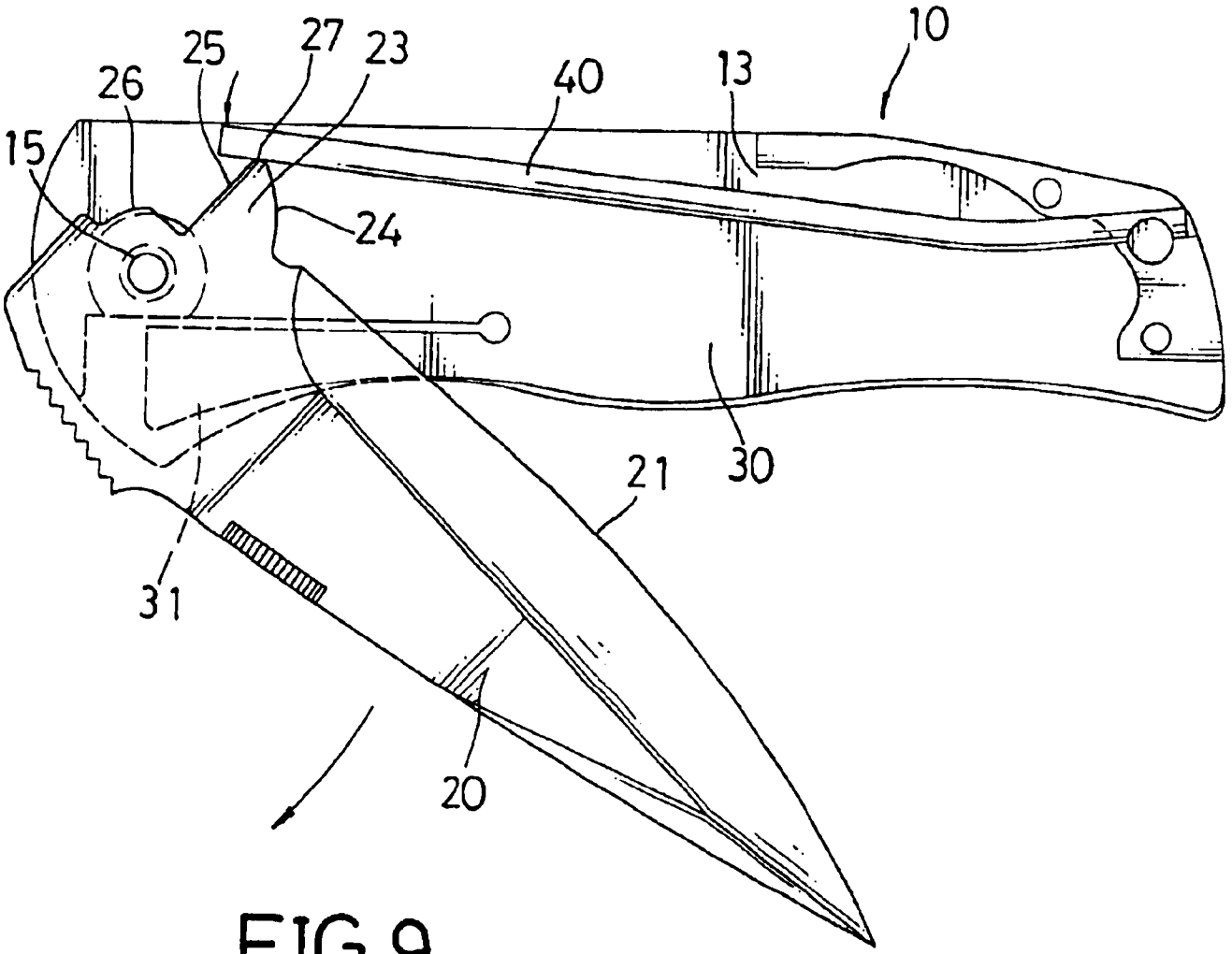
FIG. 9 is a plan view of the pocket knife previous shown in FIG. 1 currently having the blade pulled out at a predetermined angle.
Figure 10:
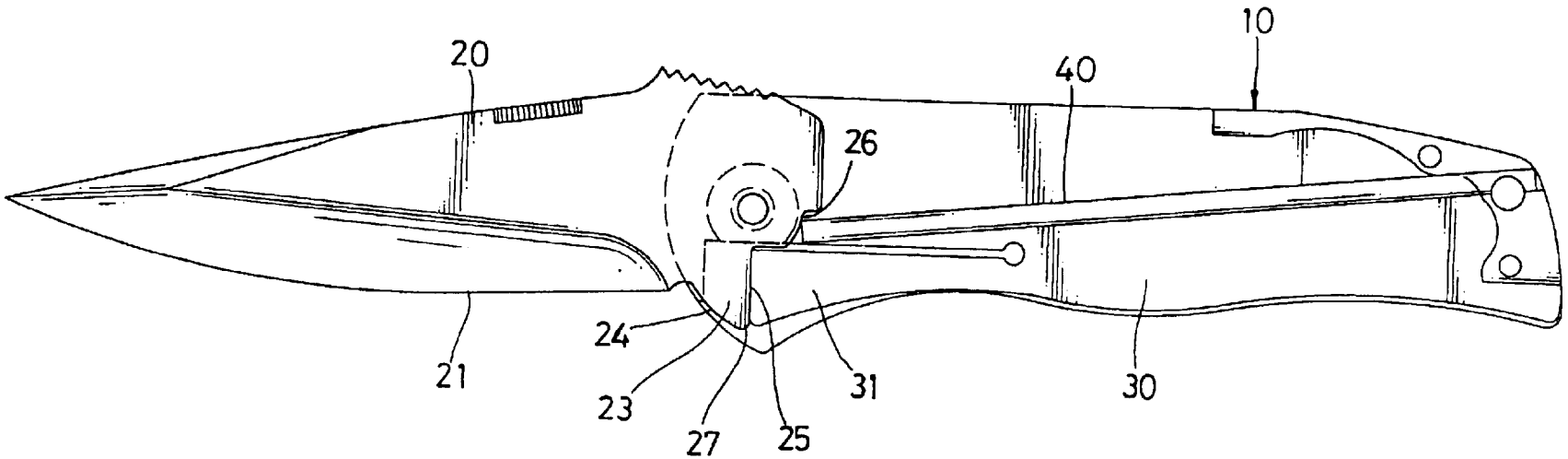
FIG. 10 is a plan view of the pocket knife previously shown in FIG. 1 currently having the blade fully extended.

When pulling out the blade (20) from the handle (10), as shown in FIGS. 9 and 10, the blade (20) is first pulled out manually to a predetermined angle, and the protruding point (27) between the guiding edge (23) and the driving edge (25) is moved to the side of the free end of the resilient pin (40), such that the force of push plate (31) of the safety lock (30) pushing against the blade (20) is lessened, and therefore the recoiling force of the resilient pin (40) acts as a supplemental driving force to extend the blade (20) from the handle (10). When the blade (20) is pivoted to the front of the handle (10), the push plate (31) of the safety lock (30) engages the driving edge (25) of the shoulder (23) on the blade (20), and the free end of the resilient pin (40) extends to the pin catch (26) of the blade (20) for moving the blade (20) into open position, such that the user can hold on to the handle (10) and use the cutting edge (21) of the blade (20). When closing the knife, the user only has to press down the push plate (31) of safety lock (30) to cause the blade (20) to be released from the shoulder (23), such that the blade (20) can then be put back pivotally into the handle (10).

In summary, the present invention provides a pocket knife with lock design having a mechanical driving aid for assisting the extension of the blade (20) into the open position semi-automatically, and a foldable design by means of a pivot joint. Furthermore, the present invention also provides a simplified knife structure that helps provide a minimum thickness of handle suitable for portability and storage.

The foregoing description of the preferred embodiments of the present invention is intended to be illustrative only and, under no circumstances, should the scope of the present invention be so restricted.

What is claimed is:

1. A pocket knife with a lock design, comprising a handle (10), a chamber (13), a blade (20), a safety lock (30), and a resilient pin (40); wherein the handle (10) is composed of a first half (11) and a second half (12);

the chamber (13) is defined by the space between the first half (11) and the second half (12);

the blade (20) is pivotally coupled to the handle (10) by a pivot joint (15), and has a cutting edge (21), a shoulder (23) at the end of the cutting edge (21), a guiding edge (24) on the lateral side of the shoulder (23) adjacent to the cutting edge (21), a driving edge (25) on the other side far away from cutting edge (21) and perpendicular to an axis of the blade (20), and a pin catch (26) on the side wall of driving edge (25);

the safety lock (30) is secured inside the chamber (13) with one end fixed inside the handle (10), and has a push plate (31) with a raised head for engaging the shoulder (23) at the end of the blade (20) to move the blade (20) into an open position; and the resilient pin (40) is secured in the chamber (13) of the handle (10), with one end having a gap (41) formed therein and being fixed on the handle (10) and the other end being pressed against the shoulder (23) of the blade (20), the handle (10) having a holding block (14) in the chamber (13) displaced from the pivot joint (15) for holding the resilient pin (40) firmly in place, the resilient pin (40) being placed at a base of the handle (10), and the handle (10) having a through hole formed therein for holding a stopper rod (17) to fix a base of the resilient pin (40) inside the handle (10).

2. The pocket knife as claimed in claim 1, wherein the holding block (14) in the chamber (13) of the handle (10) is formed by two long blocks juxtaposedly disposed in the handle (10), and a space defined between the long blocks forms a channel (16) for keeping the resilient pin (40) in position.

3. The pocket knife as claimed in claim 1, wherein the holding block (14) in the chamber (13) of the handle (10) is formed by multiple blocks in two rows, alternately positioned, and a space defined between the long blocks forms a channel (16) for keeping the resilient pin (40) in position.

4. The pocket knife as claimed in claim 1, wherein the first half (11) and second half (12) respectively have through holes (111, 112) and screw holes for receiving screws to fix the base of the resilient pin (40) inside the handle (10).

5. The pocket knife as claimed in claim 2, wherein the first half (11) and second half (12) respectively have through holes (111, 112) and screw holes for receiving screws to fix the base of the resilient pin (40) inside the handle (10).

6. The pocket knife as claimed in claim 3, wherein the first half (11) and second half (12) respectively have through holes (111, 112) and screw holes for receiving screws to fix the base of the resilient pin (40) inside the handle (10).

7. The pocket knife as claimed in claim 1, wherein the base of the resilient pin (40) has a large diameter portion at one end of the resilient pin, and a back end of the handle (10) has a supporting pipe (19) having a smaller diameter inner section (191) and a larger diameter outer section (192), where the outer section (192) of the supporting pipe (19) has screw threads on the inner edge matching the outer edge of the resilient pin (40) having a large diameter base, and the inner section (191) of the supporting pipe (19) corresponds with the outer diameter of the resilient pin (40), such that resilient pin (40) can be inserted into the handle (10) through the inner section (191) of the supporting pipe (19), and the base of the resilient pin (40) is pressed against the supporting pipe (19), and a screw is inserted into the outer section (192) of the supporting pipe (19) for fixing the base of the resilient pin (40) inside the handle (10).

8. The pocket knife as claimed in claim 2, wherein the base of the resilient pin (40) has a large diameter portion at one end of the resilient pin, and a back end of the handle (10) has a supporting pipe (19) having a smaller diameter inner section (191) and a larger diameter outer section (192), where the outer section (192) of the supporting pipe (19) has screw threads on the inner edge matching the outer edge of the resilient pin (40) having a large diameter base, and the inner section (191) of the supporting pipe (19) corresponds with the outer diameter of the resilient pin (40), such that resilient pin (40) can be inserted into the handle (10) through the inner section (191) of the supporting pipe (19), and the base of the resilient pin (40) is pressed against the supporting pipe (19), and a screw is inserted into the outer section (192) of the supporting pipe (19) for fixing the base of the resilient pin (40) inside the handle (10).

9. The pocket knife as claimed in claim 3, wherein the base of the resilient pin (40) has a large diameter portion at one end, and a back end of the handle (10) has a supporting pipe (19) having a smaller diameter inner section (191) and a larger diameter outer section (192), where the outer section (192) of the supporting pipe (19) has screw threads on the inner edge matching the outer edge of the resilient pin (40) having a large diameter base, and the inner section (191) of the supporting pipe (19) corresponds with the outer diameter of the resilient pin (40), such that resilient pin (40) can be inserted into the handle (10) through the inner section (191) of the supporting pipe (19), and the base of the resilient pin (40) is pressed against the supporting pipe (19), and a screw is inserted into the outer section (192) of the supporting pipe (19) for fixing the base of the resilient pin (40) inside the handle (10).

* * * * *